US009902558B2

(12) United States Patent
Genter et al.

(10) Patent No.: US 9,902,558 B2
(45) Date of Patent: Feb. 27, 2018

(54) HOPPER RELEASE SYSTEM

(71) Applicant: ROURA MATERIAL HANDLING, INC., Clinton Township, MI (US)

(72) Inventors: Michael David Genter, Clarkston, MI (US); David Bryan Vinson, Livonia, MI (US)

(73) Assignee: ROURA MATERIAL HANDLING, INC., Clinton Township, MI (US)

( * ) Notice: Subject to any disclaimer, the term of this patent is extended or adjusted under 35 U.S.C. 154(b) by 540 days.

(21) Appl. No.: 14/522,023

(22) Filed: Oct. 23, 2014

(65) Prior Publication Data

US 2016/0114971 A1 Apr. 28, 2016

(51) Int. Cl.
*B65D 88/56* (2006.01)

(52) U.S. Cl.
CPC ..... *B65D 88/56* (2013.01)

(58) Field of Classification Search
CPC ..... B65D 88/56
See application file for complete search history.

(56) References Cited

U.S. PATENT DOCUMENTS 3,486,648 A * 12/1969 Dewald ..... B66F 9/19 298/17.5
3,881,617 A * 5/1975 Miller ..... B66F 9/19 414/422
5,364,224 A * 11/1994 Padgett ..... B66F 9/19 414/419
5,951,230 A * 9/1999 Kruzick ..... B65D 88/56 414/420
6,715,980 B2 * 4/2004 Bouthillier ..... B66F 9/19 298/17 R
6,733,225 B1 * 5/2004 Barnett ..... B66F 9/19 298/38
7,004,514 B2 * 2/2006 Franich ..... B65F 1/12 292/101

* cited by examiner

*Primary Examiner* — Jonathan Snelting
(74) *Attorney, Agent, or Firm* — Cantor Colburn LLP

(57) ABSTRACT

A hopper release system includes a base member configured and disposed to selectively support a hopper, and a hopper release assembly mounted to the base member. The hopper release assembly includes a remote hopper release member configured and disposed to selectively disengage a hopper retaining member from the hopper.

13 Claims, 8 Drawing Sheets

HOPPER RELEASE SYSTEM

BACKGROUND OF THE INVENTION

Exemplary embodiments pertain to the art of material handling hoppers and, more particularly, to a hopper release system for a material handling hopper.

Material hoppers are used to store and/or transport a wide range of materials in an installation. Hoppers may be employed to store and transport raw material, finished products and/or waste materials. In many cases, a hopper is loaded with material in one location and transported to another location for unloading. Typically, the hopper is carried by a forklift and pivoted, or rotated about, a base allowing the material to spill out to a desired area. Each hopper includes a manually operated release mechanism. After transporting to a desired position, an operator alights from the forklift to release the hopper to spill any material contained therein.

BRIEF DESCRIPTION OF THE INVENTION

Disclosed is a hopper release system including a base member configured and disposed to selectively support a hopper, and a hopper release assembly mounted to the base member. The hopper release assembly includes a remote hopper release member configured and disposed to selectively disengage a hopper retaining member from the hopper.

Also disclosed is a hopper system including a hopper base having a hopper retaining assembly and a hopper supported upon the hopper base. The hopper includes a hopper retaining element selectively captured by the hopper retaining assembly. A hopper release system is configured and disposed to receive the hopper base. The hopper release system includes a base member and a remote hopper release member mounted to the base member. The remote hopper release assembly is configured and disposed to selectively disengage the hopper retaining assembly from the hopper retaining element.

Further disclosed is a method of discharging a hopper including positioning the hopper having a hopper retaining pin on a hopper base having a hopper retaining assembly, engaging a hopper retaining element of the hopper with the hopper retaining assembly, supporting the hopper base on a base member of a hopper release system, and selectively activating a remote hopper release member disengaging the hopper retaining assembly from the hopper retaining element allowing the hopper to pivot relative to the hopper release system.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
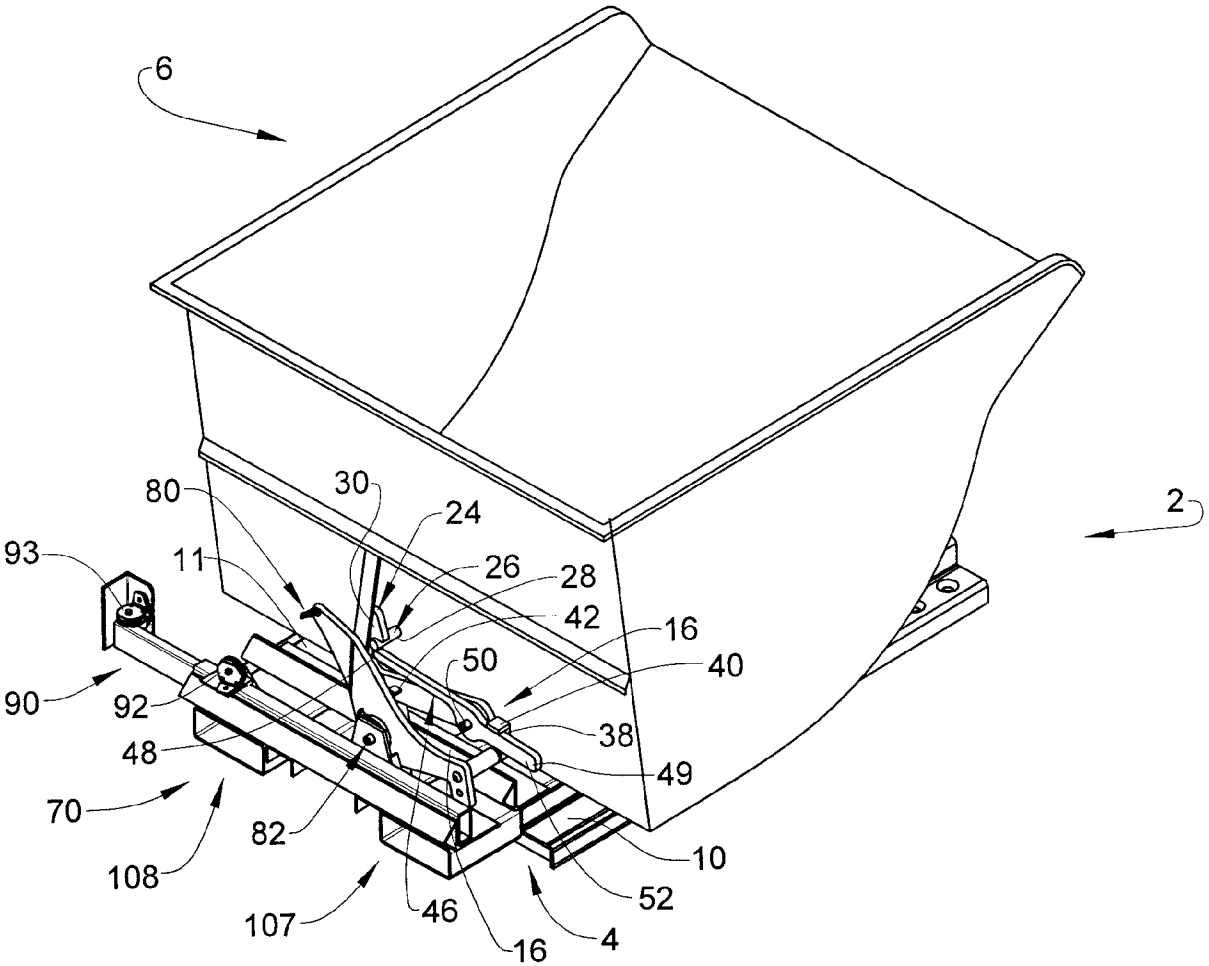
FIG. 1 depicts a hopper system including a hopper release system, in accordance with an exemplary embodiment.
Figure 2:
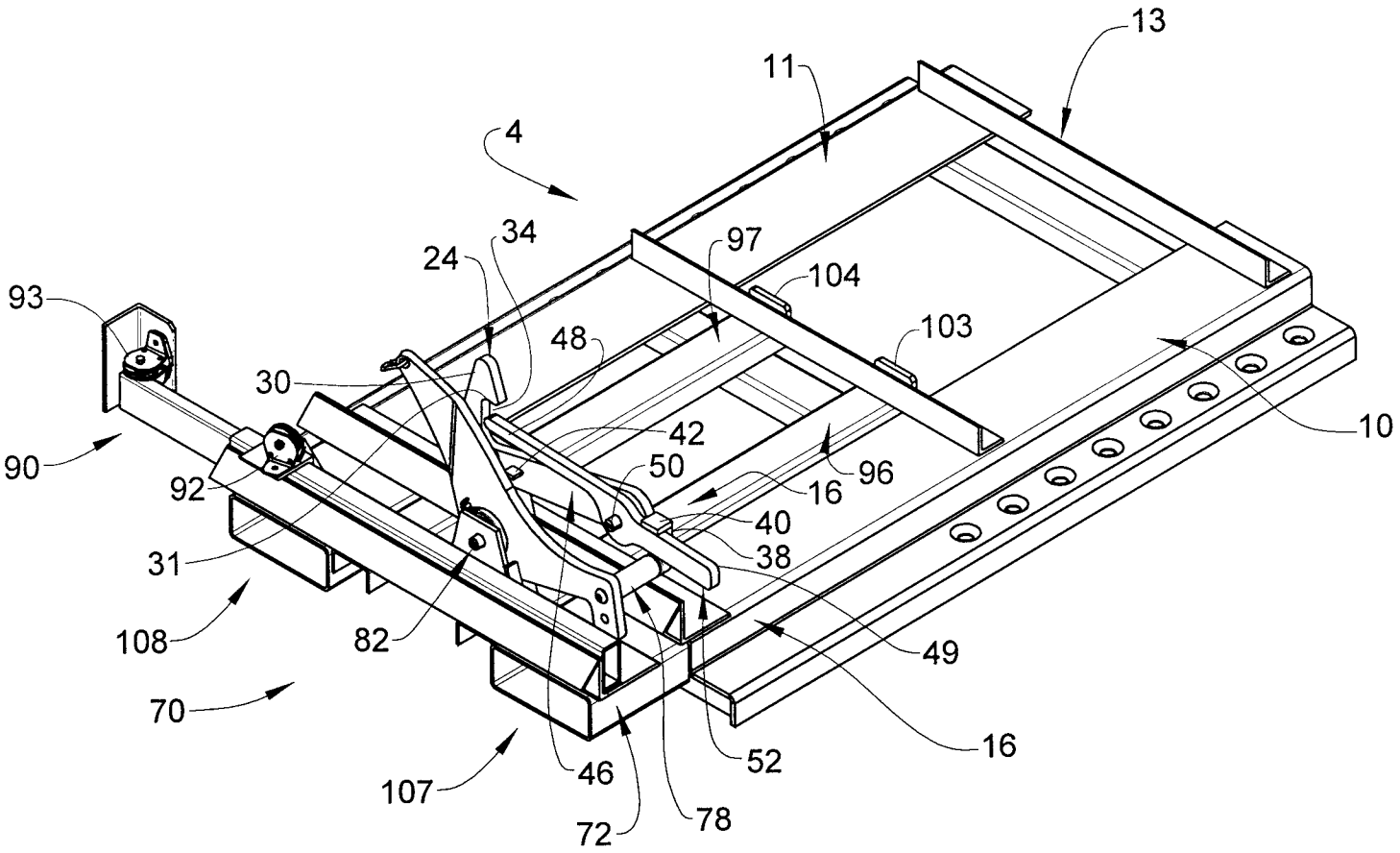
FIG. 2 depicts the hopper system of FIG. 1 with the hopper removed.
Figure 3:
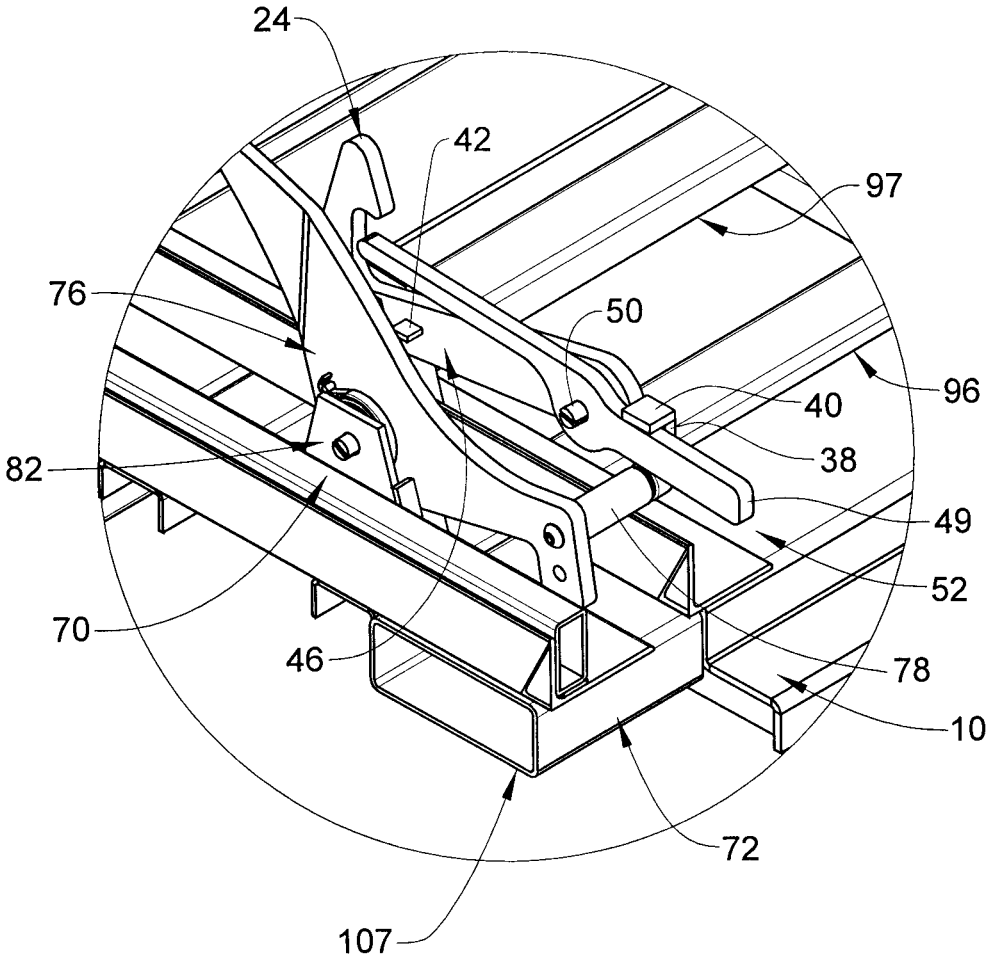
FIG. 3 depicts the hopper release system of FIG. 1.

A hopper system, in accordance with an exemplary embodiment, is indicated generally at 2, in FIGS. 1-3. Hopper system 2 includes a hopper base 4 supporting a hopper 6. Hopper base 4 includes a first support 10 and a second support 11 joined by a plurality of crossbars, one of which is indicated at 13. Hopper base 4 also includes a hopper retaining assembly 16, which, as will be detailed more fully below, enables hopper 6 to pivot about hopper base 4 releasing material stored therein.

Hopper retaining assembly 16 includes a hook element 24 that selectively engages a hopper retaining element 26 on hopper 6. In the exemplary embodiment shown, hopper retaining element 26 takes the form of a pin 28 extending substantially perpendicularly from hopper 6. However, it should be understood that hopper retaining element 26 may take on a variety of forms. Hook element 24 extends from a first end 30, defining a hook 31 having a hook gap 34, to a second, cantilevered end 38. Hook element 24 also includes a first hook element release engagement member 40 arranged at second end 38 and a second hook element release engagement member 42 arranged at hook 31. Hopper retaining assembly 16 also includes a hook element release 46 pivotally mounted to hook element 24. Hook element release 46 extends from a first end 48 to a second end 49 through a pivot 50. Second end 49 defines a handle 52.

Figure 4:
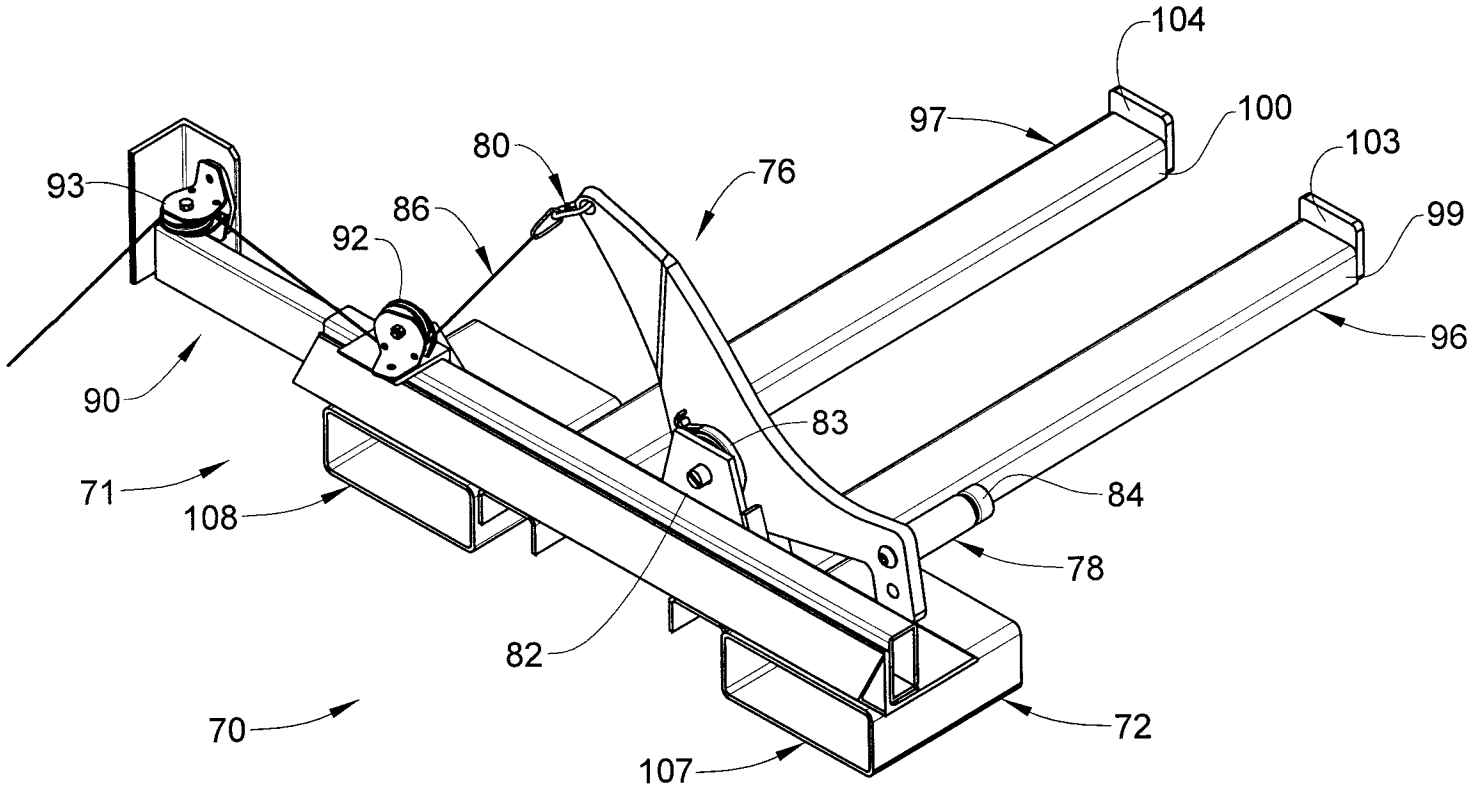
FIG. 4 depicts a detailed view of a remote hopper release member and hopper retaining assembly of FIG. 1.
Figure 5:
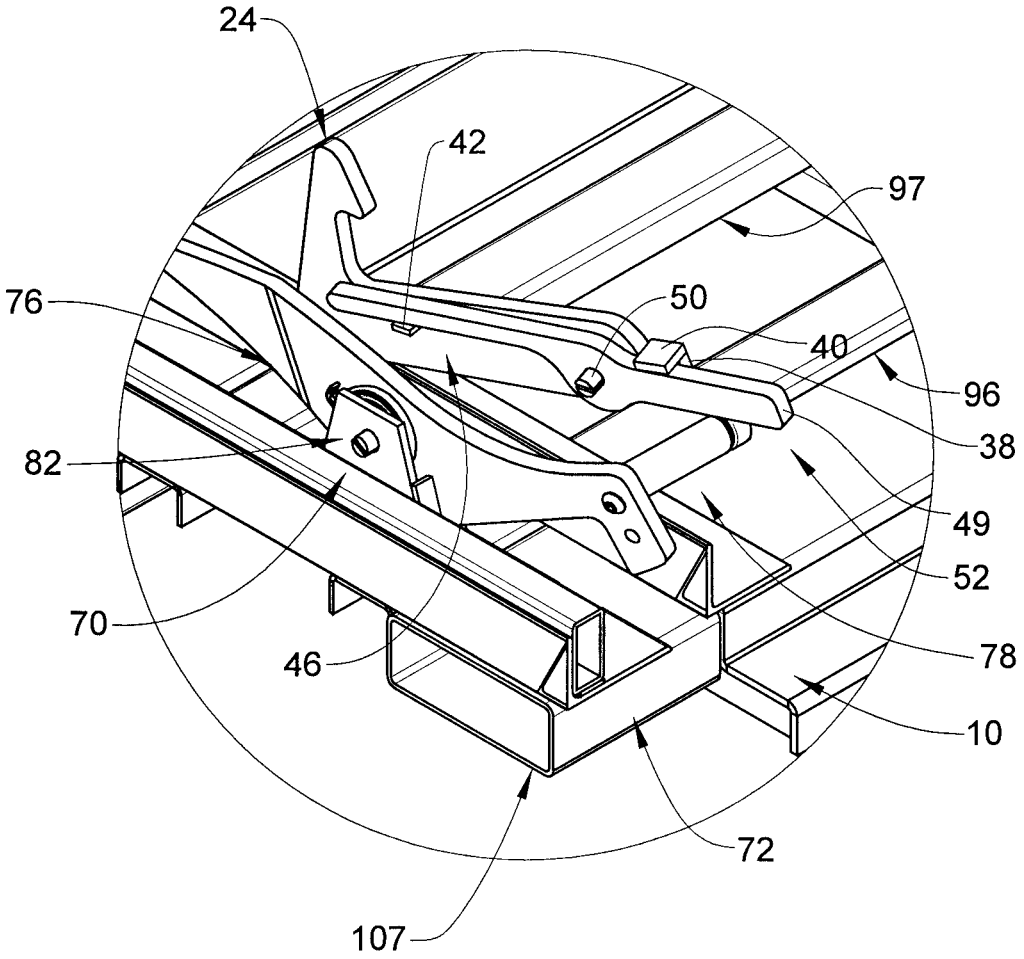
FIG. 5 depicts the remote hopper release member disengaging the hopper retaining assembly.

In accordance with an exemplary embodiment, hopper system 2 further includes a hopper release system 70, illustrated in FIG. 4. Hopper release system 70 includes a base member 72 supporting hopper release assembly 71 including a remote hopper release member 76. In the exemplary aspect shown, remote hopper release member 76 includes a hook element release actuator 78 and a remote signal input member 80 arranged on either side of a central pivot 82. Central pivot 82 also supports a return spring 83. In accordance with an aspect of the exemplary embodiment, hook element release actuator 78 may take the form of a pin element 84 extending substantially perpendicularly from remote hopper release member 76. Remote signal input member 80 takes the form of a cable 86. Upon receipt of a remote activation signal through cable 86, remote hopper release member 76 shifts pin element 84 from a first position, such as shown in FIG. 3, to a release position, such as shown in FIG. 5. More specifically, pin element 84 moves into contact with, and raises, second end 49 of hook element release 46 pivoting hook element 24 away from pin 28. At this point, hopper 6 may rotate forward to expel any materials contained therein.

In further accordance with an exemplary aspect, hopper release system 70 includes a selectively adjustable remote signal input support 90 extending from base member 72. Adjustable remote signal input support 90 includes a first pulley 92 and a second pulley 93 that receive cable 86. Adjustable remote signal input support 90 may slide or shift to selectively position second pulley 93 a desired distance from base member 72. Hopper release system 70 includes a first hopper support element 96 and a second hopper support element 97 that engage with hopper base 4. Each hopper support element 96, 97 includes a corresponding end portion 99, 100 having a respective end stop member 103 and 104. End stop members 103 and 104 may engage with one of crossbars 13 to prevent hopper base 4 from separating from hopper release system 70.

Figure 6:
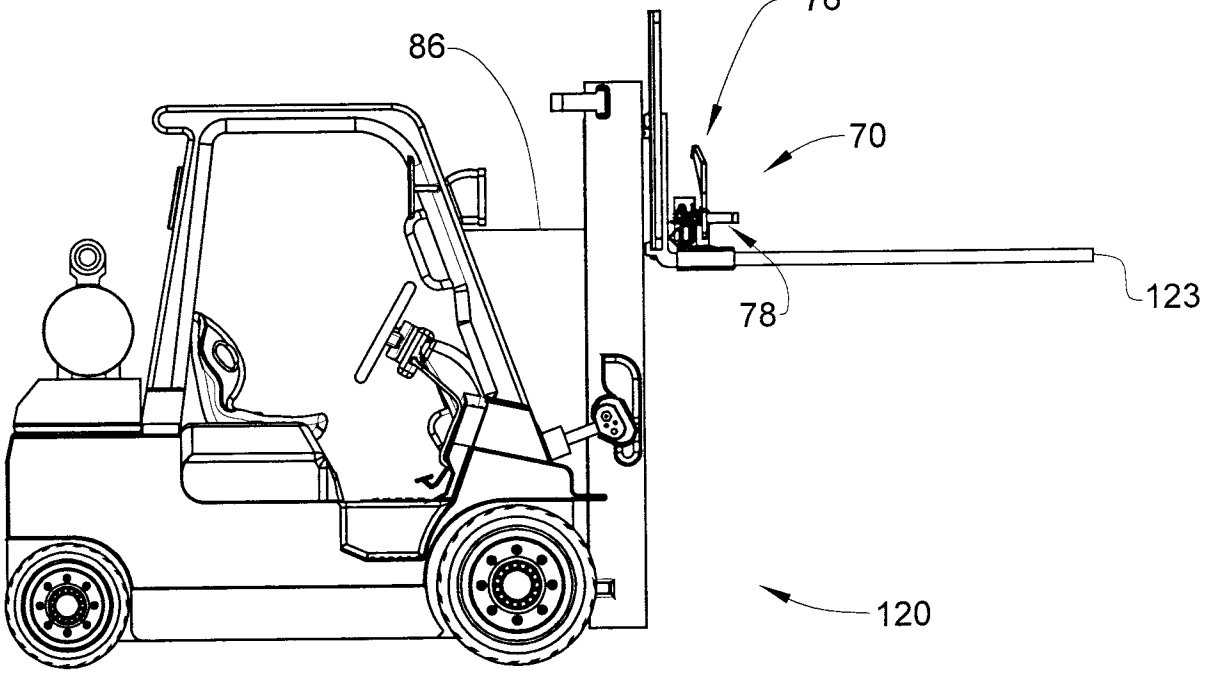
FIG. 6 depicts the hopper release system, in accordance with an exemplary embodiment, mounted to forks of a forklift.
Figure 7:
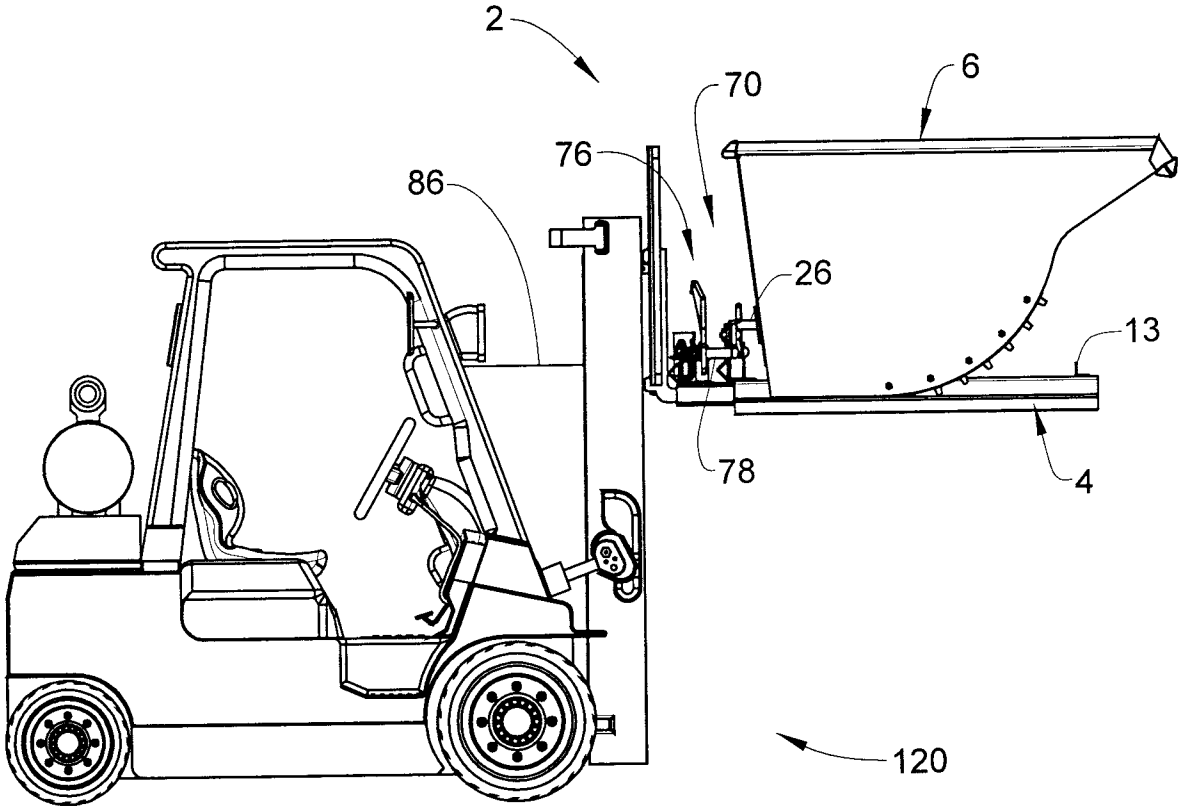
FIG. 7 depicts the hopper release system of FIG. 6 supporting a hopper on a hopper base.
Figure 8:
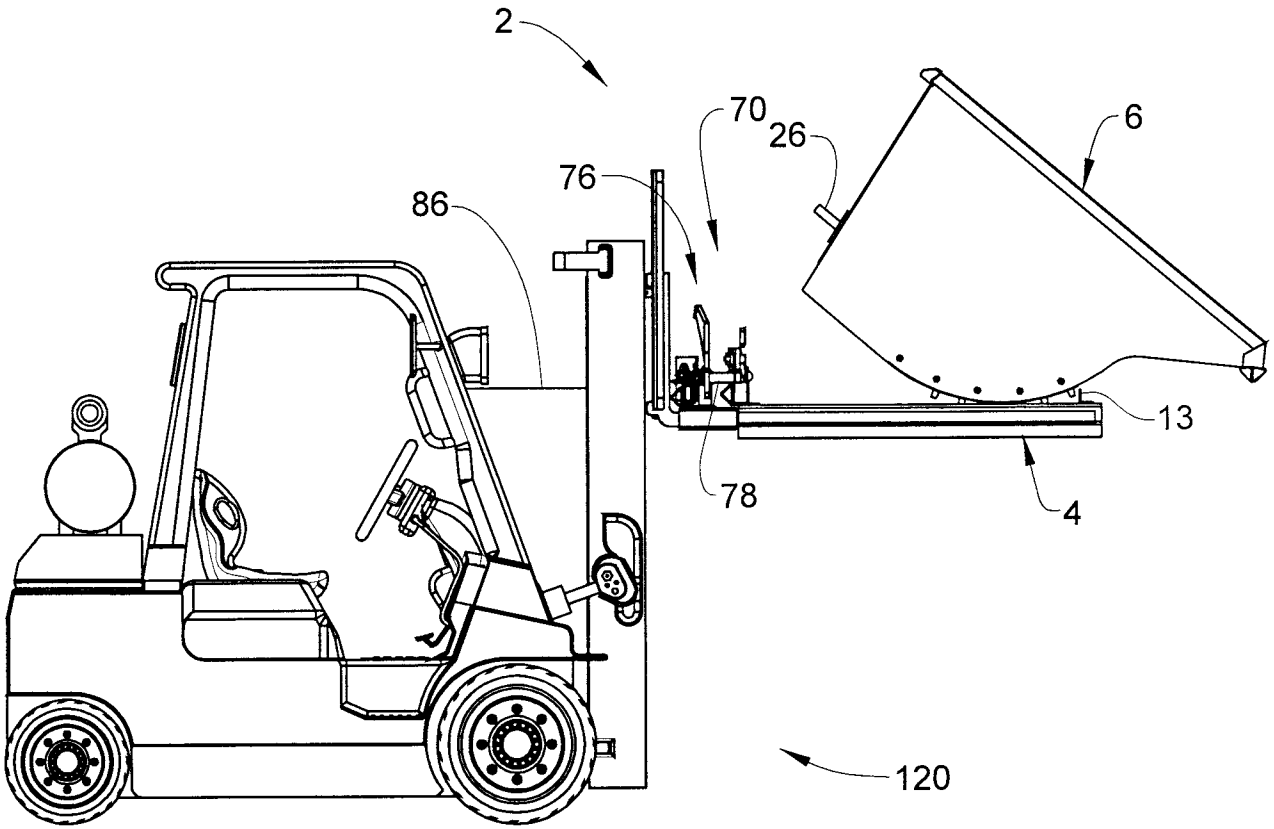
FIG. 8 depicts the hopper released from the hopper base.

In further accordance with an exemplary embodiment, hopper release system 70 includes a first fork pocket 107 and a second fork pocket 108 mounted to base member 72. In this manner, a forklift 120, such as shown in FIG. 6, may capture hopper release system 70 on forklift members or forks, such as indicated at 123. At this point, hopper base 4 and hopper 6 may be positioned on hopper release system 70, such as shown in FIG. 7. FIG. 8 depicts hopper 6 pivoting about hopper base 4 after a remote release signal was input to hopper release system 70.

At this point, it should be understood that the hopper release system provides a universal release for a hopper. That is, users may purchase a single hopper release instead of the need for a remote release associated with each hopper. Further, the hopper release, in accordance with exemplary embodiments, provides a user with a single set up that may be used with a number of hoppers instead of the need to configure a remote release for each hopper.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A hopper release system comprising:

a base member configured and disposed to selectively support a hopper; and a hopper release assembly mounted to the base member, the hopper release assembly including a remote hopper release member configured and disposed to selectively disengage a hopper retaining element from the hopper, the remote hopper release member including a hook element release actuator defined by a pin element which is selectively engageable with a hopper mounted release handle that disengages a hook element from a hopper retaining element.

2. The hopper release system according to claim 1, wherein the remote hopper release member includes a remote signal input member and a central pivot arranged between the hook element release actuator and the remote signal input member.

3. The hopper release system according to claim 2, wherein the pin element extends substantially perpendicularly from the remote hopper release member.

4. The hopper release system according to claim 1, further comprising: a first hopper support element and a second hopper support element configured and disposed to support a hopper base, each of the first and second hopper support elements including an end stop member that limits travel of the hopper base relative to the base member.

5. The hopper release system according to claim 1, further comprising: first and second fork pockets mounted to the base member, the first and second fork pockets being configured and disposed to receive corresponding first and second forklift members.

6. A hopper system comprising:

a hopper base including a hopper retaining assembly;

a hopper detachably supported upon the hopper base, the hopper including a hopper retaining element selectively captured by the hopper retaining assembly, and hook element release including a handle, and a hook element selectively engageable with the hopper retaining element; and a hopper release system configured and disposed to selectively receive the hopper base, the hopper release system including a base member supporting the hopper and a hopper release assembly mounted to the base member, the hopper release assembly including a remote hopper release member, the remote hopper release member being configured and disposed to selectively disengage the hopper retaining assembly from the hopper retaining element, the remote hopper release member including a hook element release actuator defined by a pin element which is selectively engageable with the handle to disengage the hook element from a hopper retaining element.

7. The hopper system according to claim 6, wherein the hook element release is pivotally mounted to the hook element.

8. The hopper system according to claim 6, wherein the hook element extends from a first end including a hook having a gap to a second, cantilevered end, the hook element release being mounted at the second, cantilevered end.

9. The hopper system according to claim 8, wherein the hook element release extends from a first end arranged at the gap to a second end defining a handle.

10. The hopper system according to claim 9, wherein the hook element includes a first hook element release engagement element mounted at the second end and a second hook element release engagement element mounted adjacent the hook.

11. The hopper system according to claim 10, wherein the remote hopper release member includes a hopper retaining member release actuator, a remote signal input member and a central pivot arranged between the hopper retaining member release actuator and the remote signal input member.

12. The hopper system according to claim 6, wherein the base member includes a first hopper support element and a second hopper support element supporting the hopper base, each of the first and second hopper support element including an end stop member that limits travel of the hopper base relative to the base member.

13. The hopper system according to claim 6, further comprising: first and second fork pockets mounted to the base member, the first and second fork pockets being configured and disposed to receive corresponding first and second fork lift members.

* * * * *